United States Patent [19]

Anderson

[11] 4,304,307

[45] Dec. 8, 1981

[54] SCRAPER BLADE ATTACHMENT FOR TRACTORS

[76] Inventor: Ernest L. Anderson, 85115 Florence Rd., Eugene, Oreg. 97405

[21] Appl. No.: 128,169

[22] Filed: Mar. 7, 1980

[51] Int. Cl.[3] ..... E02F 3/76

[52] U.S. Cl. ..... 172/791; 172/306; 172/796; 172/797

[58] Field of Search ..... 172/297, 306, 308, 273, 172/743, 767, 781, 788, 789, 791, 792, 793, 795, 796, 797, 803, 804; 37/42 VL

[56] References Cited

U.S. PATENT DOCUMENTS

| | | | |
|---|---|---|---|
| 2,147,207 | 2/1939 | Nikkel | 172/795 |
| 2,883,776 | 4/1959 | Orscheln | 172/788 |
| 2,947,097 | 8/1960 | Toews | 172/788 |
| 3,007,266 | 11/1961 | Brand | 172/788 |
| 3,381,760 | 5/1968 | Braud | 172/788 |
| 3,556,228 | 1/1971 | Mork | 172/767 X |
| 3,618,671 | 11/1971 | Chantland | 172/297 |
| 4,148,365 | 4/1979 | Anderson | 172/781 |
| 4,161,987 | 7/1979 | Tolmer | 172/796 X |
| 4,175,625 | 11/1979 | Puckett | 172/797 X |
| 4,222,442 | 9/1980 | Westendorf et al. | 172/273 |

*Primary Examiner*—Richard T. Stouffer
*Attorney, Agent, or Firm*—James D. Givnan, Jr.

[57] ABSTRACT

A scraper blade attachment including a blade assembly located between the front and rear wheels of the tractor and supported by forwardly extending rail members swingably coupled to the forward end of a tractor frame. The rail members and the blade assembly are vertically positioned as well as transversely inclined by hydraulic cylinders supported by the tractor frame. Box beam sections of the scraper blade assembly adjustably receive the rail members. Similarly, an anti-sway assembly is also adjustably mounted on the scraper blade assembly and extends rearwardly for pivotal coupling to the tractor frame. A blade swing cylinder is also supported by the anti-sway assembly.

6 Claims, 7 Drawing Figures

SCRAPER BLADE ATTACHMENT FOR TRACTORS

BACKGROUND OF THE PRESENT INVENTION

The present invention pertains to tractor mounted attachments and particularly to such an attachment having a scraper blade disposed intermediate the front and rear pairs of tractor wheels.

The prior art includes a tractor attachment disclosed in U.S. Pat. No. 4,148,365 issued to the present inventor which patent discloses a tractor scraper blade attachment wherein the blade is located intermediate the front and rear wheels of the tractor. Vertical positioning of the patented scraper blade attachment is accomplished with the lift arms of the tractor's three-point attachment.

Additionally within the prior art are other tractor attachments such as shown in U.S. Pat. Nos. 3,007,266; 3,381,760; 3,618,671; 2,147,207; 2,883,776 and 4,071,090 all having scraper blades disposed intermediate the front and rear pairs of tractor wheels and powered by various power cylinder arrangements. All known powered scraper blade attachments are of a complex nature suitable for use with a particular tractor model and not readily modified for attachment to a range of tractor sizes and models. Further, when in place on the tractor, the cylinder powered scraper blade attachments are not readily detachable to free the tractor for other operations besides scraping and leveling ground surfaces. Still further, the prior art does not disclose a scraper blade attachment of compact configuration having power cylinders and an anti-sway link closely coupled to the blade to advantageously support the blade against extreme assymetrical loads. The blade supporting arrangements shown on the cylinder powered scraper attachments are coupled to the front and/or rear axles of the tractor by complex linkages resulting in a scraper blade attachment of limited capability and susceptible to damage by severe side loading. Further, such attachments are of costly manufacture.

SUMMARY OF THE PRESENT INVENTION

The present invention is embodied within a tractor scraper blade attachment having a scraper blade assembly located intermediate the tractor wheels supported by detachable rail members in closely coupled engagement with the tractor frame and suitable, with limited effort, for attachment to a wide range of tractors.

The forward end of the present scraper attachment is removably coupled to the forward end of the tractor frame with coupling accomplished by insertable pin members. A coupling assembly permits the rearwardly extending rail members to move vertically in an independent manner in response to hydraulic cylinder actuation as well as being jointly transversely inclined relative the tractor frame. Said rail members terminate in removable securement to the scraper blade assembly. Also in securement with the blade assembly is a rearwardly extending anti-sway assembly coupled to the tractor rear axle housing. The rail members and anti-sway assembly are interchangeable with other like members to enable mounting of the scraper blade assembly on various styles and sizes of tractors. Accordingly, a single scraper blade assembly may be adapted for tractor securement to a wide range of tractors simply by substitution of relatively low cost components.

Important objectives of the present scraper blade attachment include the provision of a hydraulically actuated scraper blade disposed intermediate the front and rear wheels of a tractor with the scraper blade being highly adaptable to installation on various sizes and models of tractors by low cost modification of associated rail members; the provision of a scraper blade attachment for tractors swingably coupled to the forward end of the tractor frame and detachable therefrom upon the extraction of quick release type pin members; the provision of a compact scraper blade attachment for mounting below a tractor frame in a close coupled manner to provide an attachment not susceptible to damage by over stressing as incurred by similar attachments utilizing elongate support arms and linkages.

DETAILED DESCRIPTION OF THE PREFERRED EMBODIMENT

Figure 1:
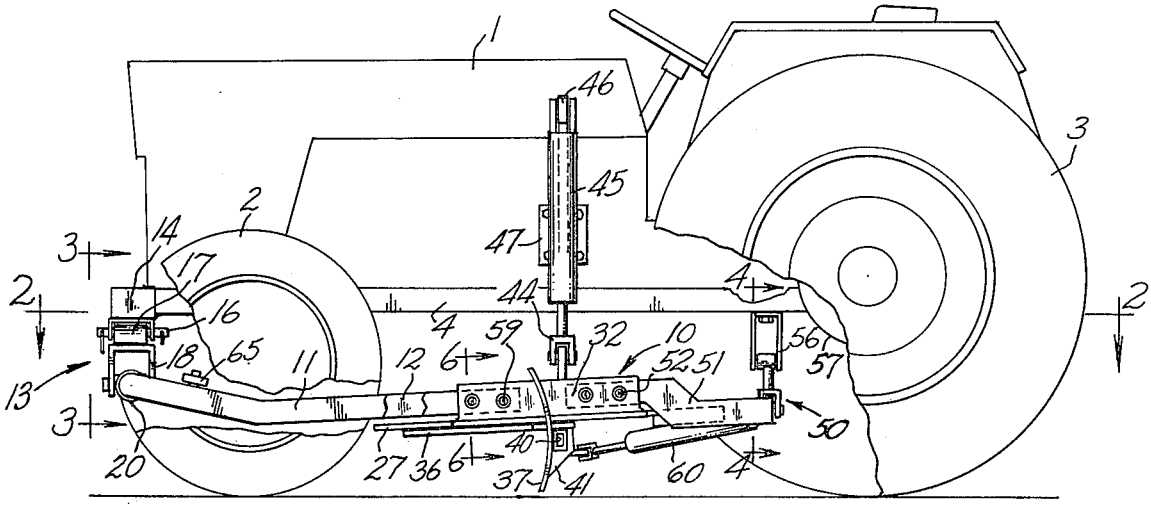
FIG. 1 is a side elevational view of a tractor with the present attachment in place.
Figure 2:
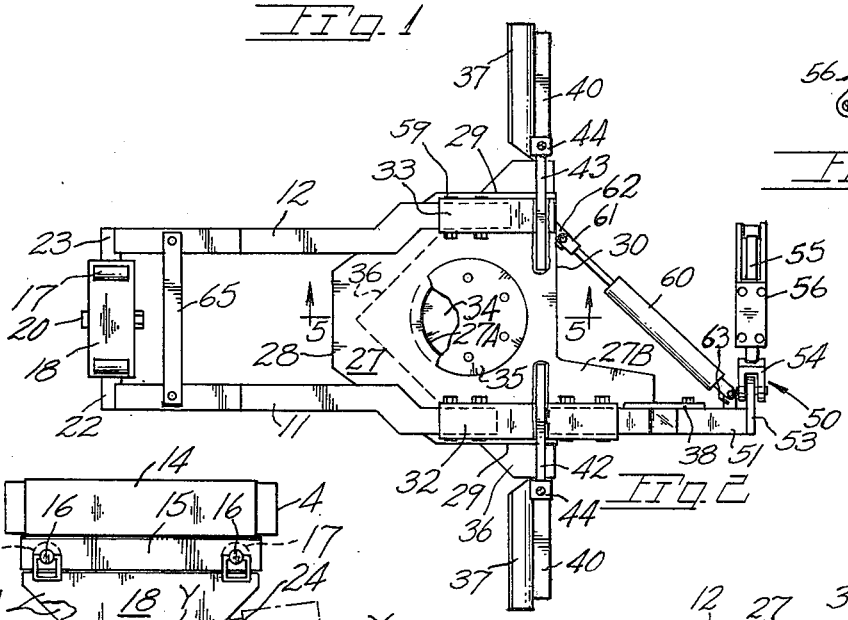
FIG. 2 is a plan view of the attachment taken downwardly along line 2—2 of FIG. 1.
Figure 4:
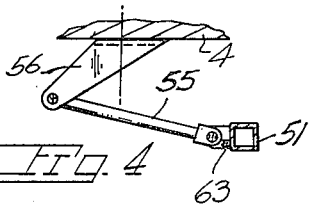
FIG. 4 is a vertical elevational view of an attachment sway bar taken along line 4—4 of FIG. 1.

With continuing attention to the drawing wherein applied reference numerals indicate parts similarly hereinafter identified, the reference numeral 1 indicates a conventional tractor of the type normally utilized in agricultural operations having steerable front wheels 2 and powered rear wheels 3. A tractor frame at 4 supports front wheels 2 and rear wheels 3 in the conventional manner as well as the engine and drive train components.

A blade support assembly is indicated at 10 intermediate the front and rear tractor wheels. Extending forwardly from said assembly are a pair of elongate rail members 11 and 12 which terminate forwardly adjacent the forward end of the tractor frame.

Mounted at the forward end of the tractor frame is a coupling assembly indicated generally at 13 which includes a mounting component 14 welded or otherwise secured to tractor frame 4. Secured to the underside of component 14 is an inverted channel segment 15 having downwardly directed flanges. Quick release type pins at 16 are insertable through said flanges and through bosses at 17 both of which bosses are integral with the web of a clevis structure 18 to permit detachment of same upon pin extraction. Pivot means shown as a pin 20 extends through clevis walls 18A and through an interposed sleeve 21 thereby permitting sleeve movement about the horizontal axis at Y of pivot pin 20.

Figure 3:
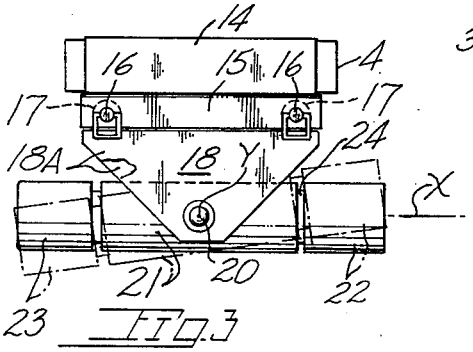
FIG. 3 is a vertical elevational view of a coupling assembly taken along line 3—3 of FIG. 1.
Figure 5:
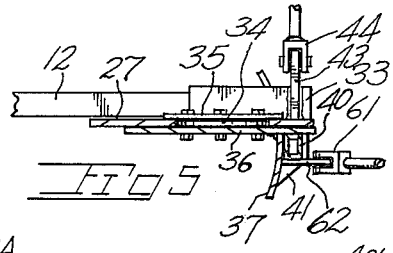
FIG. 5 is a vertical sectional view taken along line 5—5 of FIG. 2.

Rail members 11 and 12 terminate forwardly in cylindrical caps 22 and 23 which internally receive stub shafts 24 which extend inwardly for journalled reception within opposite ends of sleeve 21. From the foregoing it will be seen that rails 11 and 12 may move independently about a sleeve axis at X and further may move jointly about the axis Y of pivot pin 20, as shown in broken lines in FIG. 3, for transverse inclination of the rails.

With attention again to the blade support assembly at 10, the same includes an uppermost base plate 27 having a forward edge 28, side edges 29 and a rearward edge 30. Secured as by welding to the upper surface of base plate 27 is a box beam section 32 while a similar but shorter box beam section at 33 is secured to the remaining side of the base plate both sections receiving rearward rail segments. A turntable at 34 is confined within a base plate opening 27A by a cover plate 35. Secured to the underside of turntable 34 is a movable plate 36 adapted for rotation about the turntable center. Carried by movable plate 36 is a scraper blade 37 with scraper blade securement and reinforcement enhanced by a beam 40 substantially coterminous with the blade. Gussets at 41 reinforce blade to beam securement. A median segment of blade 37 is of reduced height and welded along its upper edge to the underside of movable plate 36. A main plate rearward extension 27B carries a brace 38 bolted to a later described weldment 51.

Blade support assembly 10 further includes brackets at 42 and 43 which extend upwardly and outwardly from welded securement with main plate 27 and with box beam sections 32 and 33 with the brackets receiving the rod ends 44 of a pair of hydraulic cylinders as at 45. The base end of each cylinder is supported by the distal end of a support arm as at 46 (FIG. 1) carried by a mounting plate 47 in bolted securement with the tractor frame. The term tractor frame is used in its broadest sense to also include tractor engine and transmission components mounted to the frame proper.

An anti-sway assembly, generally at 50, includes rearwardly extending box beam weldment 51 of stepped configuration, having a forward segment in inserted attachment with box beam section 32. Fastener assemblies as at 52 extend through beam section 32 and through weldment 51 inserted in the end of same. The rear end of beam weldment 51 carries an upright ear 53 to which is pivotally attached a clevis 54 of an anti-sway bar 55. The bar upper end is pivotally secured within a bracket 56 secured to the tractor frame forwardly of the tractor differential housing at 57.

With attention again to the blade support assembly 10, a blade swing cylinder at 60 is attached at its rod end 61 to a blade mounted ear 62 while the base end of cylinder 60 is pivotally attached to an ear 63 on the inner side of box beam weldment 51.

Figure 6:
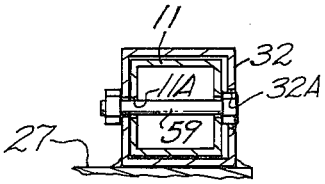
FIG. 6 is a vertical sectional view taken along line 6—6 of FIG. 1.

With reference to FIG. 6, a typical fastener assembly at 59 is shown having its head in abutment with the inserted end segment of rail member 11. Openings as at 11A and 32A enable selective fastener placement for effective rail member length to best suit the tractor to which the attachment is being mounted.

Suitable conduits and controls are in communication with the double acting hydraulic cylinders 45 to permit powered raising and lowering of blade support assembly 10 as well as transverse inclination of same by differential cylinder actuation of the cylinders. Cylinder 60 is likewise controlled for swinging blade 37.

Figure 7:
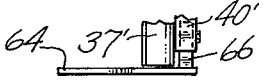
FIG. 7 is a plan view of a scraper blade end segment with an end blade insertably mounted thereon.

The blade support assembly 10 is of substantially fixed design with the exception of brackets 42 and 43 which will vary in placement and size to suit the specific tractor on which the attachment is to be used. Similarly mounting component 14 of coupling assembly 13 may be modified in an inexpensive manner to suit tractor frame configuration. Variations in tractor size may be compensated, as earlier noted, by the interfitting and securing of the rails 11 and 12 within box beam sections 32 and 33 by fasteners assemblies 59. The same is true for adjustment of beam weldment 51. A tie bar at 65 prevents any spreading tendency of rail members 11 and 12. In FIG. 7 a modified scraper blade 37' includes an end plate at 64 removably mounted to the end of blade beam 40' by inserted tubular segment 66 and confines scraped material ahead of the blade.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

I claim:

1. A scraper blade attachment for tractors comprising, a scraper blade assembly for disposition intermediate the front and rear wheels of a tractor and including powered means for coupling to said tractor, rail members extending forwardly from said scraper blade assembly for termination below the tractor forward end, an anti-sway assembly extending rearwardly from said scraper blade assembly and including a sway bar terminating upwardly in a tractor mountable bracket, a coupling assembly for securement to the forward end of the tractor and including a sleeve component, said sleeve component pivotally receiving the rail member forward ends, said coupling assembly further including a mounting component for tractor attachment, an inverted channel segment carried by said mounting component, said channel segment defining openings therethrough a clevis structure including bosses registerable with channel segment openings, removable pin means insertable through the openings and said bosses, pivot pin means mounting the sleeve component to said clevis, said sleeve component supported by said pivot pin means in a manner permitting sleeve component movement about a horizontal axis alignable parallel to the tractor centerline to permit the rail members to be transversely inclined relative to said centerline, and said scraper blade assembly additionally including box beam means in inserted engagement with the rearwardmost segments of said rail members.

2. The scraper blade attachment claimed in claim 1 wherein said box beam means comprises box beam sections within which are secured rearward segments of said rail members, fastener assemblies removably inserted through said box beam sections and said rearward segments to permit lengthwise adjustable engagement of said rail members and said sections.

3. The scraper blade attachment claimed in claim 2 wherein one of said box beam sections also serves to receive the forward end of said anti-sway bar assembly.

4. The scraper blade attachment claimed in claim 3 wherein additional fastener assemblies on said one of said box beam sections are engageable with the anti-sway bar assembly to permit lengthwise adjustable engagement of said one box beam section with the anti-sway bar assembly.

5. The scraper blade attachment claimed in claim 3 wherein said anti-sway bar assembly additionally serves to mount one end of a blade swing cylinder of said scraper blade assembly.

6. The scraper blade attachment claimed in claim 1 wherein said scraper blade assembly includes an earth working blade, a beam of tubular construction secured lengthwise to said blade, an end plate removably carried by the tubular beam and disposed perpendicularly to the blade end to confine earthen material forward of same.

* * * * *